US005669182A

United States Patent [19]

Griffis

[11] Patent Number: 5,669,182

[45] Date of Patent: Sep. 23, 1997

[54] COCOON

[76] Inventor: Richard L. Griffis, 942 SW. 11th St., Boca Raton, Fla. 33432

[21] Appl. No.: 453,168

[22] Filed: Aug. 14, 1995

[51] Int. Cl.[6] ..... E04G 11/04

[52] U.S. Cl. ..... 52/2.18; 52/2.23; 52/2.24; 135/93; 135/95; 135/137

[58] Field of Search ..... 52/2.22, 2.24, 52/2.18, 2.23; 135/93, 91, 95, 96, 137, 88.13, 88.15

[56] References Cited

U.S. PATENT DOCUMENTS

| | | | |
|---|---|---|---|
| 2,106,664 | 1/1938 | Shoglow | 135/95 |
| 2,345,377 | 3/1944 | Bowen | 135/93 X |
| 2,442,132 | 5/1948 | Laythe | 135/95 |
| 2,830,606 | 4/1958 | Daugherty | 52/2.24 X |
| 4,716,918 | 1/1988 | Hayashida et al. | 135/93 |
| 4,766,918 | 8/1988 | Odekirk | 52/2.23 |
| 4,898,085 | 2/1990 | Jarnot | 135/93 X |
| 5,007,212 | 4/1991 | Fritts et al. | 52/2.18 |
| 5,217,034 | 6/1993 | Yih et al. | 135/95 X |
| 5,502,927 | 4/1996 | Hammerton | 135/137 X |

*Primary Examiner*—Lanna Mai

[57] ABSTRACT

An inflatable; convertible shelter and flotation device used for long distance hiking and camping expeditions. Cocoon is constructed of canvas and nylon. The canvas floor base is rubberized to allow for water proofing and air containment. A nylon lining is attached to the canvas and is held in place by Velcro strips. When used as a tent Cocoon's nylon lining is unfastened to form a wedge shaped tent. The canvas base can be inflated for insulation and sleeping comfort. When used as a flotation device the canvas base with three independently inflated air panels provide buoyancy for traversing rivers and lakes. Each inflatable panel contains air tight cells of different lengths. Grommets are secured at the end of each cell and provide openings for rope to be drawn through. Grommets and rope allows a gathering together of air-cell ends. A gathering together of each end of the inflated panels allows the base to form a tubular shape. Two way zippers set at each side of the base and running parallel to the air-cells allows for the end panels to be secured together. This configuration allows for a person to be surrounded by air. The spaced opening in the zippers allows for the upper part of a body to come through and navigate or propel Cocoon by paddling. Out of water a Cocoon in this configuration can be secured up in a tree to allow for an enclosure away from the ground and animal life.

4 Claims, 4 Drawing Sheets

COCOON

BACKGROUND OF INVENTION

This invention relates to the problem of reducing the bulk and weight of necessities needed for camping expeditions. Customary camping requires materials to provide shelter, comfort and transportation. This usually includes a tent, sleeping bags or air mattresses, and boats or canoes if water is to be negotiated during trips. Depending on the area in which one camps these items may have to be carried if vehicles cannot drive near the camp sight. The weight and number of items needed for camping is directly related to the area a person can travel in time. This apparatus reduces the bulk and weight of materials having to be carried. This apparatus incorporates a shelter, an air-mattress and flotation device into one single lightweight package.

The apparatus of "Survival shelter", U.S. Pat. No. 4,607,655 to Wagner, 1986 Aug. 26, provides a survival environment and transport for the injured. It is constructed of rigid air columns. Apparatus rigidity required to secure an injured person does not allow for air columns to be narrowed to a point in which to achieve a watertight seal for flotation. A triangular configuration with openings in this apparatus is unsuited for use as a boat.

A "Hammock tent system" in U.S. Pat. No. 4,471,794 to Kirkham, Jr, 1984 Sep. 18, is a tent structure which converts into a hammock. This apparatus does not provide an enclosed tent shelter or the benefit of comfort by having an air mattress floor. As a hammock this apparatus is limited by not having the extra material needed to surround a person for protection against insects, animals and inclement weather.

The apparatus "Convertible raft, tent and mattress" in U.S. Pat. No. 4,650,432 to Sainesburry, deals with wooden rods and wooden floats to configure a box-like raft with a single floatation mattress. This apparatus draw backs are; depending solely on a single inflatable air mattress for flotation, using wooden poles that can splinter and puncture said mattress on impact, a tent construction requiring several pieces of fabric to be joined for construction.

A "Tent" in U.S. Pat. No. 1,522,512, to Hall, H. N. P., of London England, provides canvas with inset holes. These holes provide for the invention to be used as a tent and back pack. This apparatus is limited by providing only the barest of sheltering needs.

SUMMARY OF INVENTION

It is the object of the invention to provide a lightweight versatile package to eliminate the bulk of separate pieces of gear used in camping expeditions. By utilizing components of rubberized canvas, air-columns, grommets, zippers, Velcro and nylon, this single utility apparatus can be roped and configured to provide the camper with several needed camping components. The wedge shape nylon provides shelter while the canvas base provides the comfort of an air matress. Independent inflatible segements of canvas objectly aid the matress and flotation device in cases of puncturing. The loss of one segment does not impale the functionality of the apparatus in any one configeration. Grommets inset on the canvas and nylon are utilized to hold tent poles or rope to keep the wedge open. The grommets on the canvas base are used to secure the base to the ground with stakes. For creating the canoe, kayak, hammock or cocoon the grommets serve to shape the ends of the apparatus. With rope the grommets can be constricted or bunched together to a point in the case of kayak or cocoon. For shaping the canoe or hammock grommets are employed by a different roping technique. Zippers, air columns and grommets assist in forming the apparatus spicific form. The varried size of these air columns promote ends to bunch or narrow tighter. The watertight constriction is enabled by having a decreased volume of air at each end. The apparatus components cocoon or surround a person with columns of gas to protect against the elements.

BRIEF DESCRIPTION OF THE DRAWINGS

The present invention will be more fully understood by the reference of the following detailed drawings thereof when read in conjunction with the attached drawings, and wherein.

DETAILED DESCRIPTION OF PREFERRED EMBODIMENTS

Figure 1:
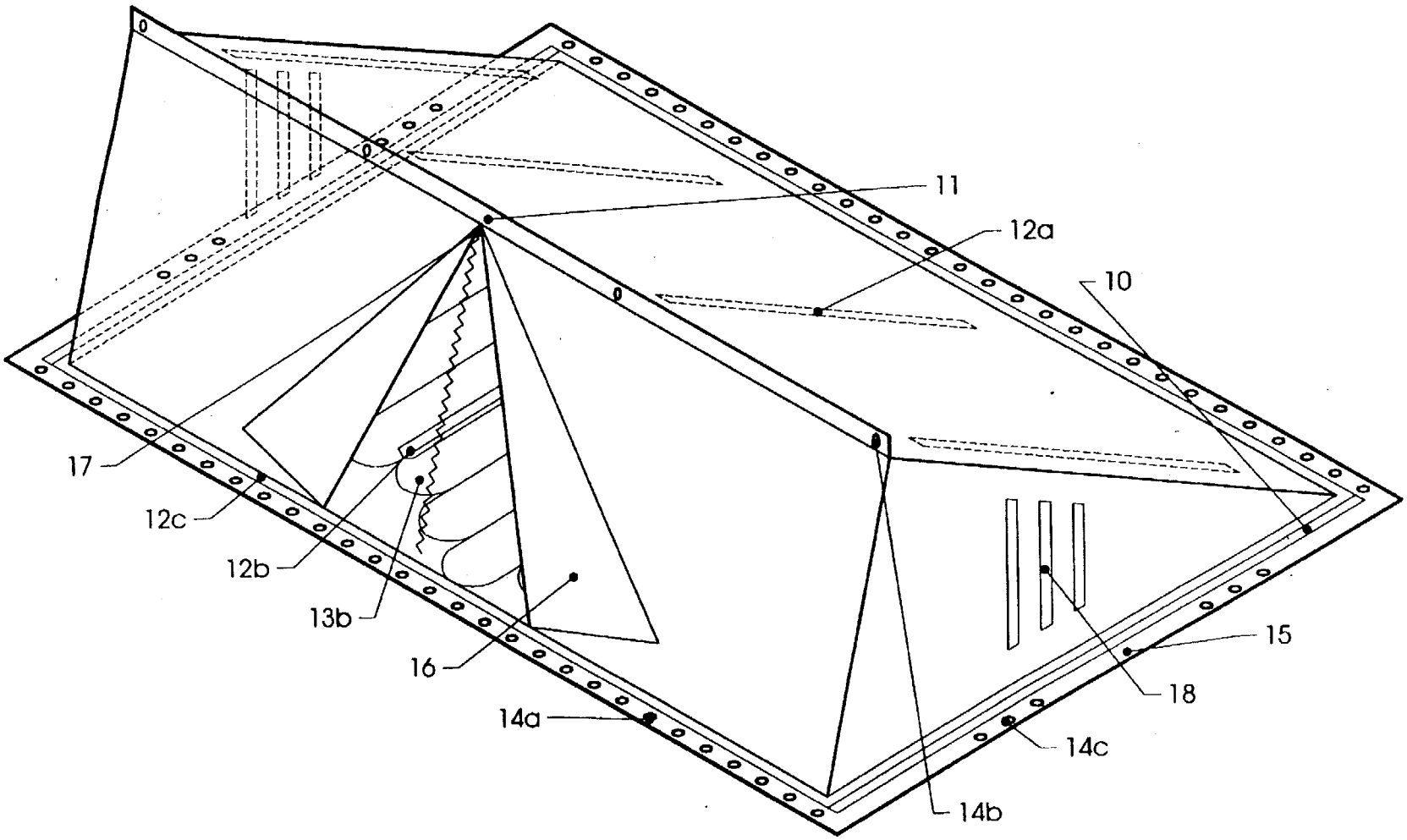
FIG. 1 is a top view of the apparatus with the tent configuration set loose from the Velcro and the tent flaps pulled back to reveal the columns of rubberized canvas.

FIG. 1 shows a top perspective view is of the apparatus in the tent configuration. The nylon lining 16 is set loose from the Velcro strips 12*a*, 12*b* and 12*c*. The nylon tent flaps 16 are pulled back revealing inflated air columns of the middle segment in the rubberized canvas base 13*b* which is the tent's floor. A boarder of Velcro 11 inset with four smaller grommets 14*a* to accommodate tent poles, sticks or rope used to keep wedge formed. The Velcro boarder 11 fits to the Velcro boarder 12*c* to hold the nylon wedge closed and in place. The tent wedge provides a space for a person to be sheltered. When tent flaps 16 are closed gill shaped air slots 18 allow for ventilation. Larger grommets 14*a* are set into both ends of the canvas base. The front grommets near the opening of the tent serve to hold the bottoms of tent poles or sticks. Both sets of grommets 14*a* can be used by tent stakes to secure the canvas base to the ground. The side of the canvas base 15 has a zipper 10 attached on the inside boarder allows for the joining of the opposing side. Smaller grommets 14*c* allow for rope to be threaded through to opposing both sides when joined by zippers. This rope secures the sides and keeps the zipper tabs from sliding open.

Figure 2:
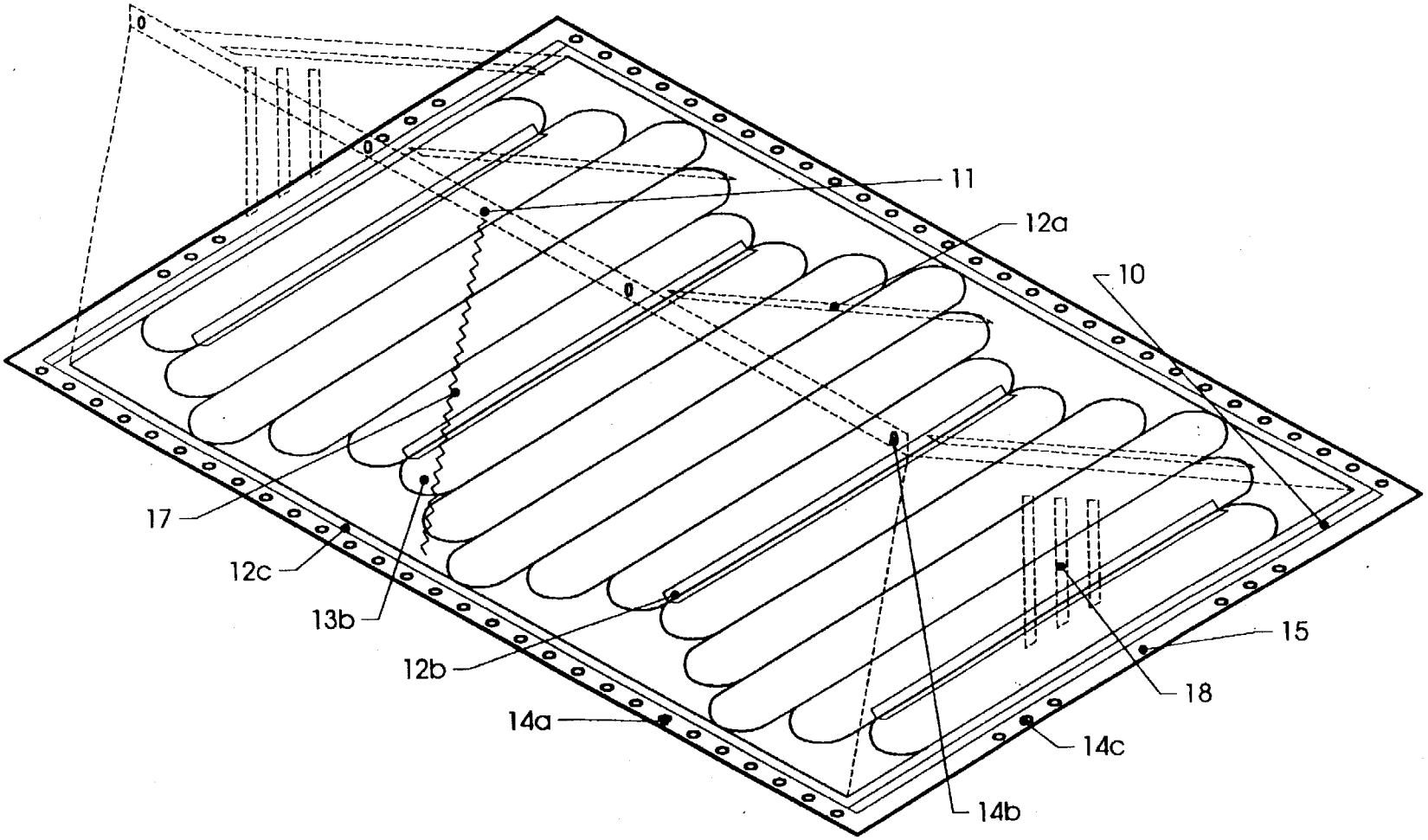
FIG. 2 is a top view of the apparatus with the nylon tent structure held in place by the Velcro and showing the inflated segments of the rubberized canvas.

FIG. 2 shows a top perspective of the canvas base 15 bordering the inflatable air columns in segments 13*a*, 13*b*, and 13*c*. The Velcro strips 12*a*, 12*b*, and 12*c* are attached with their female composites face up on the canvas air columns and the male composites facing down from the nylon. When the air columns are inflated the air pressure forces a tighter fit in the Velcro union that holds the nylon secure.

Figure 3:
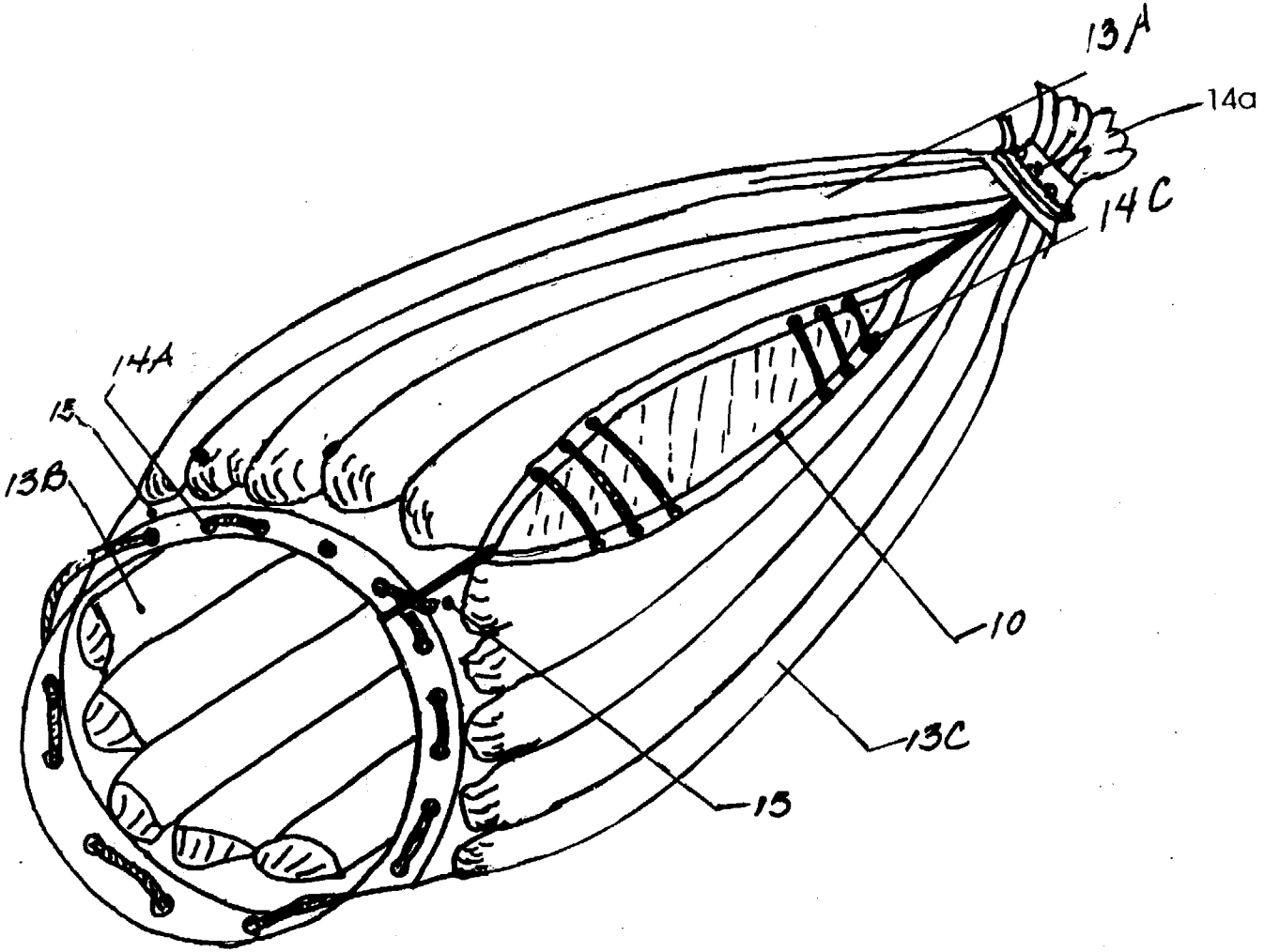
FIG. 3 is a top front view of the apparatus with the sides are zipped, the back end constricted and the front end with threaded rope.

FIG. 3 is a front top perspective of the apparatus inflated and roped in a way to show the Kayak or canoe configuration. Two zippers 10 hold the sides in place. Rope threaded through the smaller grommets 14*c* double secure the sides and hold the sliding tabs in place. The larger grommets 14*a* inset to both ends of the canvas base 15 are constricted by rope to a point. The air columns inflated on segments 13*a*, 13*b* and 13*c* have varied lengths. This facilitates the constricting and bunching together of the of the un-inflatable canvas 15 and the grommets 14.

Figure 4:
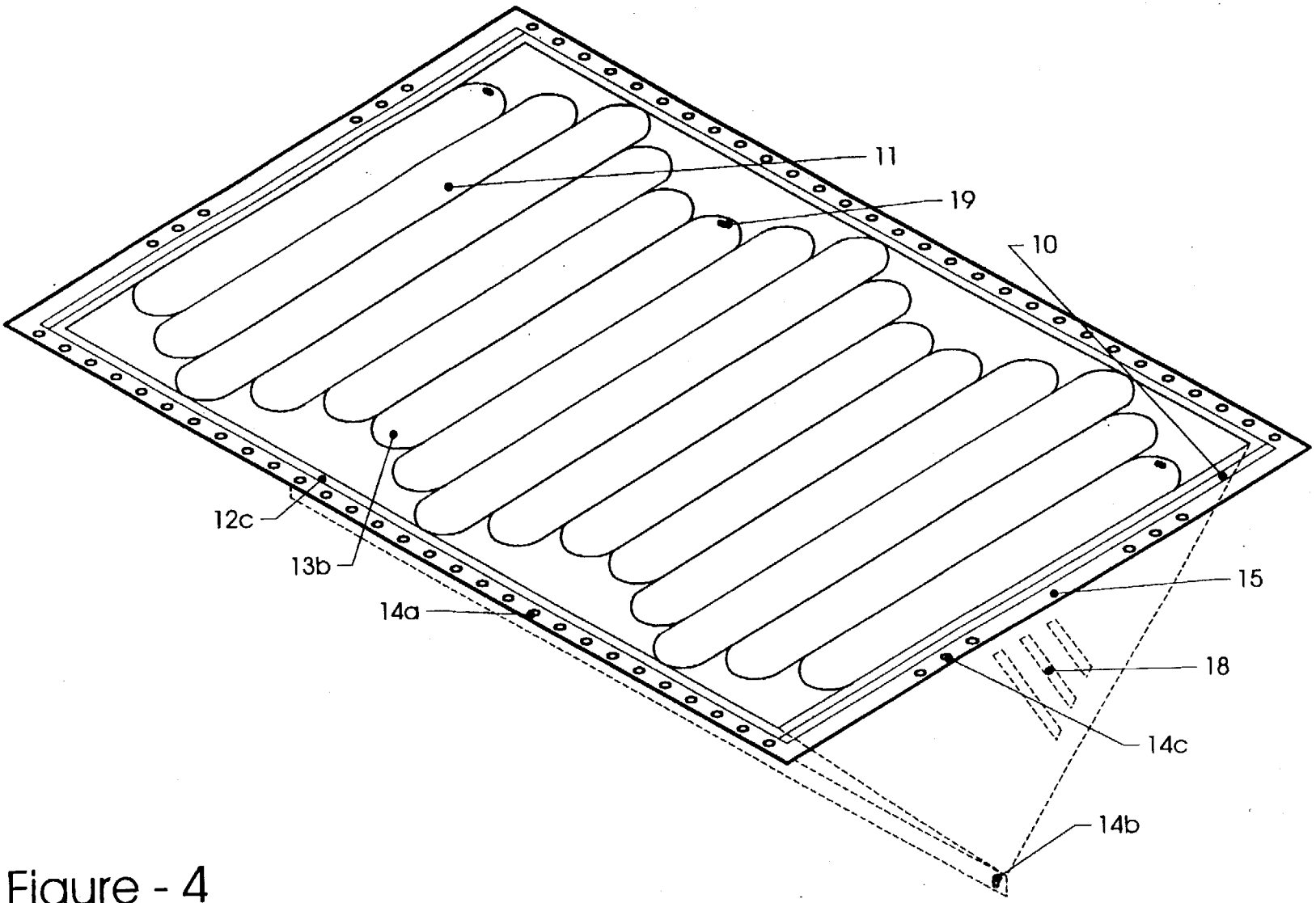
FIG. 4 is a bottom view of the apparatus with the wedge shape tent set loose from the Velcro and air columns inflated.

FIG. 4 is a bottom view perspective of the apparatus in the tent configuration. It shows the larger bordering grommets 14*a* at each end, the smaller grommets 14*c* and the zippers 10 that join the sides together. The rubberized canvas 15 holds the inflatable air columns in segments 13*b*. The canvas base has separate air valves 19. One retractable valve to inflate each segment of air columns. The nylon is set loose from the Velcro showing the air slots 18.

While certain advantageous embodiments have been chosen to illustrate the invention, it will be understood that various changes by those skilled in the art that various changes and modifications can be made therein without departing from the scope of the invention as defined in the appended claims.

What I claim is:

1. An apparatus forming a tent shelter, a canoe, a kayak and a cocoon or unclosed hammock comprising the combination of an inflatable canvas mattress base rubberized to hold air and repel water, said base having three independently inflated segments, said segments having air-columns of varied lengths;

a nylon wedge shaped lining fixed permanently to the canvas base, said wedge shape, when flattened, is to be held to the canvas by Velcro boarder and strips, said lining to have flaps which unzip to form an opening, an opening allowing a person to lie between the canvas and inside envelope created by the wedge shape, said lining having fish gill air slot for ventilation;

larger and smaller size grommets inset into the canvas, larger grommets of greater numbers set at both ends of the canvas and said smaller grommet inset in fewer numbers to both sides of the canvas;

two zippers set on the inside of the canvas boarder on both sides containing said smaller grommets, zippers joining the sides with sliding tab that work from each end towards the middle, said zippers located ¼ inch away from the smallest air columns bordering both sides of the canvas.

2. An apparatus according to claim 1 is formed by loosening nylon from Velcro to form a tent, said nylon held in place by poles inserted into the smaller grommets of the nylon and the larger grommets of the inflatable canvas base.

3. An apparatus according to claim 1 formed by inflating varied lengths of air columns, said air columns set into the independently inflated segments, said segments that can be roped with components as stated in claim 1 to form a canoe, kayak, hammock or cocoon; cocoon being defined as a surrounding case of air columns.

4. An apparatus according to claim 1, wherein a tent is formed by loosening said nylon from velcro boarder and strips, said nylon includes a plurality of small grommets thereon, a rope being threaded through said nylon's grommets and attached to elevated fixtures.

* * * * *